US005111742A

United States Patent [19]

DiDonato et al.

[11] Patent Number: 5,111,742

[45] Date of Patent: May 12, 1992

[54] MANDREL TRIP SUBASSEMBLY FOR CONTINUOUS MOTION CAN DECORATORS

[75] Inventors: Russell DiDonato, Maplewood; Enn Sirvet, Washington Township, Bergen County, both of N.J.

[73] Assignee: Sequa Corporation, New York, N.Y.

[21] Appl. No.: 565,695

[22] Filed: Aug. 13, 1990

[51] Int. Cl.[5] ..... B41F 17/22

[52] U.S. Cl. ..... 101/40

[58] Field of Search ..... 101/38.1, 39, 40, 40.1

[56] References Cited

U.S. PATENT DOCUMENTS

| | | | |
|---|---|---|---|
| 3,766,851 | 10/1973 | Sirvet et al. | 101/40 |
| 4,018,151 | 4/1977 | Urban et al. | 101/40 |
| 4,140,053 | 2/1979 | Skrypek et al. | 101/40 |

FOREIGN PATENT DOCUMENTS

| | | |
|---|---|---|
| 314973 | 5/1989 | European Pat. Off. . |
| 2229550 | 12/1974 | France . |
| 2192586 | 1/1988 | United Kingdom . |

*Primary Examiner*—Clifford D. Crowder

*Attorney, Agent, or Firm*—Mitchell D. Bittman; Jerome M. Berliner

[57] ABSTRACT

A continuous motion decorator of the type in which cans are supported on freely rotatable mandrels during decorating is provided with a plurality of equally spaced mandrel actuator subassemblies mounted along the periphery of a rotating carrier. Each subassembly is mounted for radial movement toward and away from the carrier's rotational axis with the radial position of the subassembly being controlled by a stationary closed loop cam track on which a follower roller of the subassembly is disposed. The subassembly also includes a rotary operator having a rotor that supports the mandrel and is on a pivot axis that is parallel to the axis of the carrier as well as being parallel to and laterally offset from the rotational axis of the mandrel. Sensors detect unloaded and misloaded mandrels, and upon doing so cause the rotary operator that is unloaded or misloaded to be actuated to withdraw the rotor from its normal decorating path so that it will not engage the printing blanket of a decorating unit.

13 Claims, 7 Drawing Sheets 14
17
13
20
79
40
72
76
45
71
73
68
42
77
53
54
64
67
41
52a
39
195
52b
49
48
52
88
199
197
198
95
96
97
18
19
84
82
83
81
3
3

MANDREL TRIP SUBASSEMBLY FOR CONTINUOUS MOTION CAN DECORATORS

BACKGROUND OF THE INVENTION

U.S. Pat. No. 3,766,851 issued Oct. 23, 1973 to E. Sirvet et al. for Continuous Can Printer and Handling Apparatus describes relatively high speed apparatus for applying decorations to the exterior of cylindrical containers while they are mounted on mandrels disposed along the periphery of a large rotating wheel like carrier. In continuous can printer apparatus of this type, means are provided to assure that when a mandrel moves through the decorating zone along a normal path for printing, such mandrel is properly loaded with a cylindrical container. If a particular mandrel is empty or is not properly loaded, means are provided to assure that this mandrel and/or an improperly loaded container do not engage the printing blanket. An example of prior art means for retracting unloaded and misloaded mandrels to a no-print position is disclosed in U.S. Pat. No. 4,140,053 issued Feb. 20, 1979 to J. P. Skrypek et al. for Mandrel Mounting and Trip Mechanism For Continuous Motion Decorator.

In the aforesaid U.S. Pat. No. 4,140,053 each mandrel is part of a subassembly that is mounted on a pivot axis to a continuously rotating carrier. When an unloaded or misloaded mandrel is detected a linear actuator acting through a crank and an eccentric moves the pivot axis for the entire subassembly and in so doing moves the unloaded or misloaded mandrel away from its normal path so that neither the mandrel nor a misloaded container will engage the printing blanket. While this type of mechanism operates well at high production rates, say 1200 cans per minute, mounting and dismounting of the subassembly from the carrier is time consuming and adjustments must be made while the subassembly is mounted on the carrier.

SUMMARY OF THE INVENTION

In accordance with the instant invention, the mandrel tripping actuator and mandrel are combined in a subassembly that is adjustable when the subassembly is dismounted from the carrier. In particular this subassembly includes a base with a rotary actuator thereon, which actuator is powered directly by a non-mechanical source of energy, preferably pressurized air. The actuator includes a rotor having an extension on which the mandrel is rotatably mounted and the mandrel axis is slightly offset laterally from the rotor axis so that limited pivoting motion of the latter causes the mandrel to move between a normal radially outward print position and a radially inward no-print position. Two guide rods extend from the base and are received in radial guide channels of the carrier to removably mount the subassembly on the carrier and guide the subassembly radially in accordance with dictates of a stationary cam track cooperating with a cam follower that is part of the subassembly.

Accordingly, a primary object of the instant invention is to provide an improved construction for high speed continuous motion decorators for cylindrical containers.

Another object is to provide apparatus of this type having improved means for establishing a no-print condition when an unloaded or improperly loaded mandrel is detected.

Still another object is to provide apparatus of this type that is of simplified construction.

A further object is to provide apparatus of this type constructed to simplify installation and maintenance.

A still further object is to provide apparatus of this type in which mandrel assemblies are adjustable on a bench fixture.

These objects as well as other objects of this invention shall become readily apparent after reading the following description of the accompanying drawings in which:

BRIEF DESCRIPTION OF THE DRAWINGS

In FIG. 6 the actuator is in the no-print or tripped position and in FIG. 7 the mandrel is in the normal or print position.

DETAILED DESCRIPTION OF THE DRAWINGS

Figure 1:
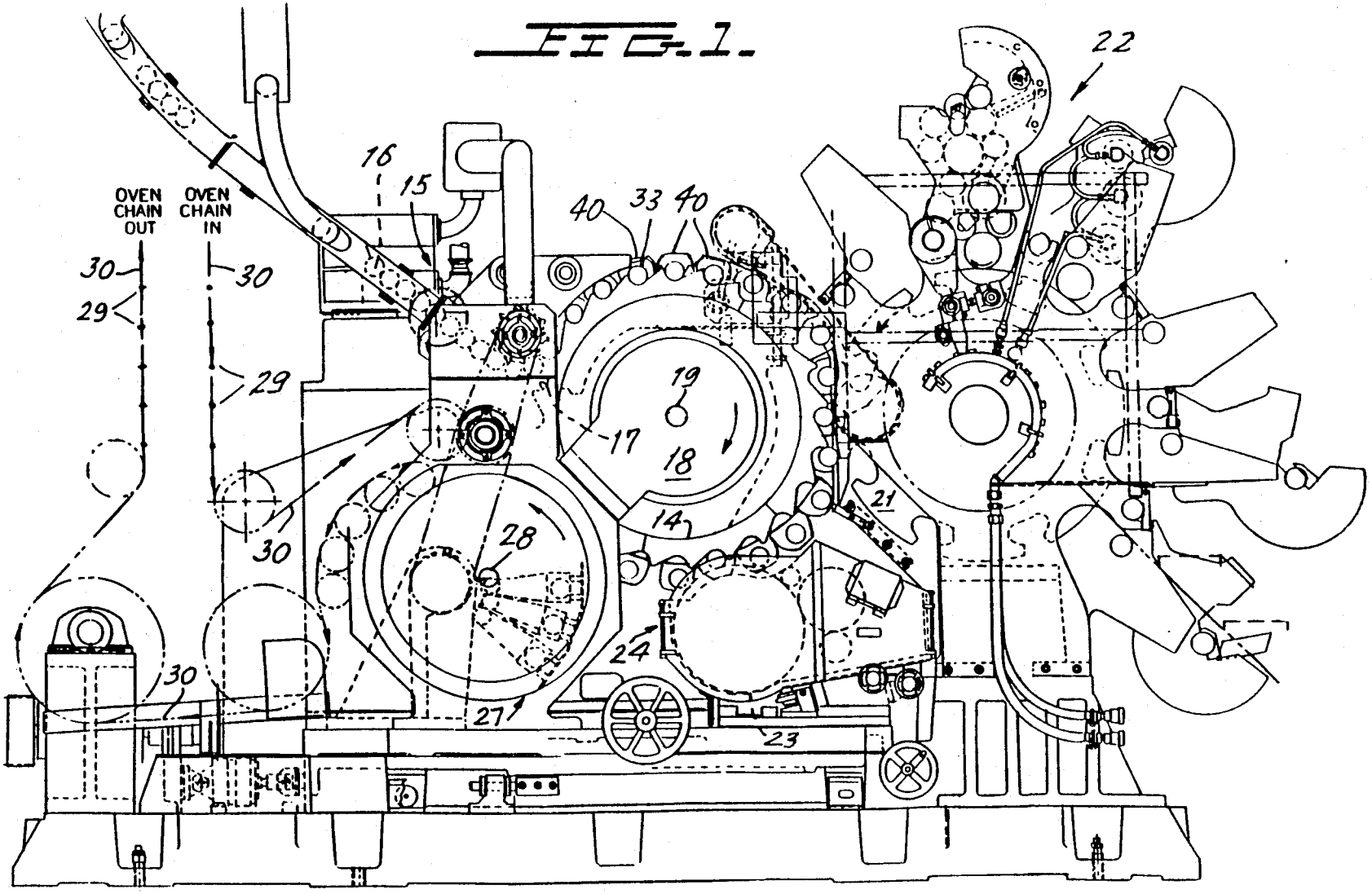
FIG. 1 is a front elevation of continuous motion decorating apparatus that includes mandrel trip means constructed in accordance with teachings of the instant invention.
Figure 2:
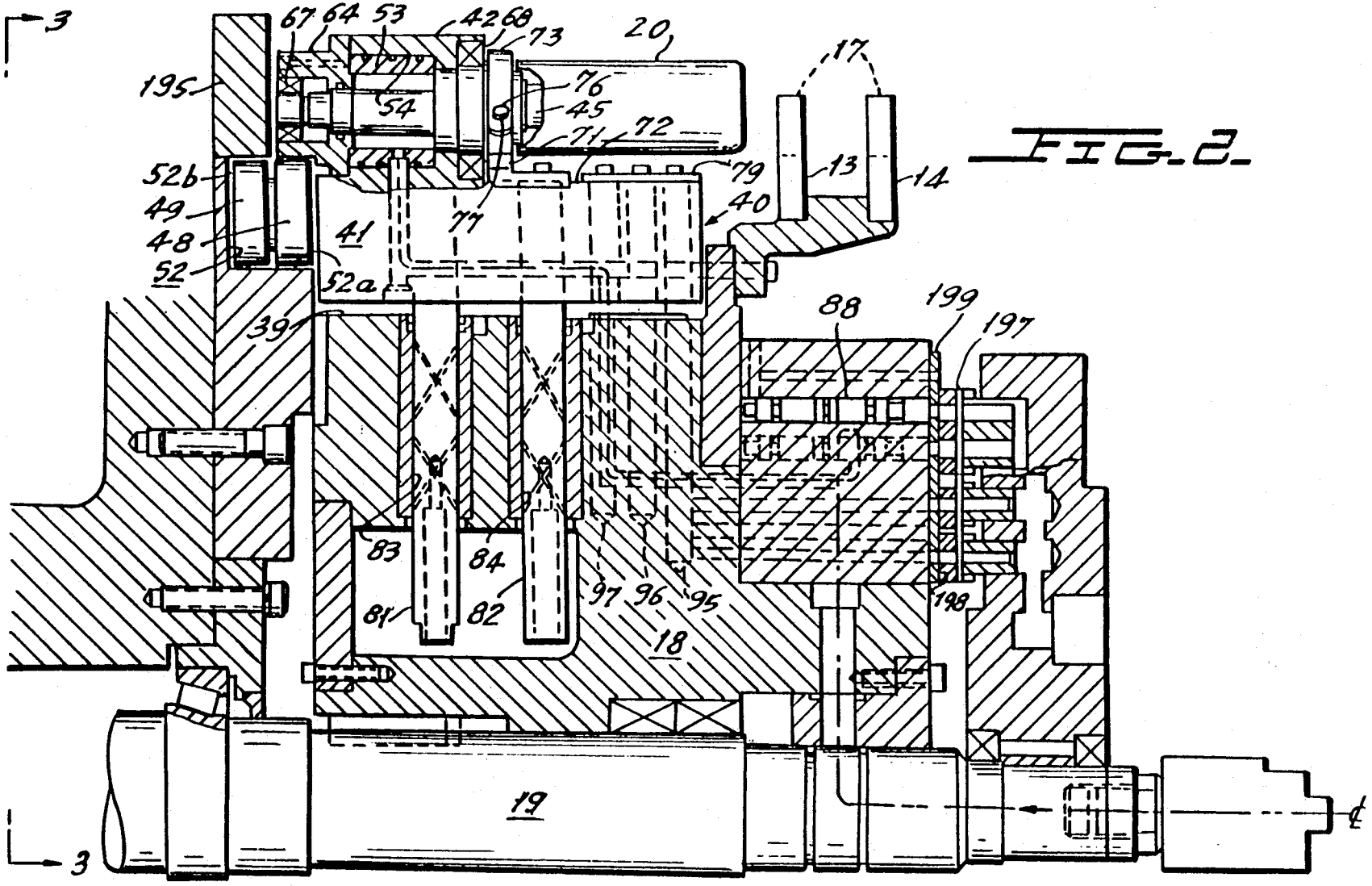
FIG. 2 is a fragmentary cross-section of the mandrel carrier and loading wheel taken through line 2—2 of FIG. 1 looking in the direction of arrows 2—2.
Figure 3:
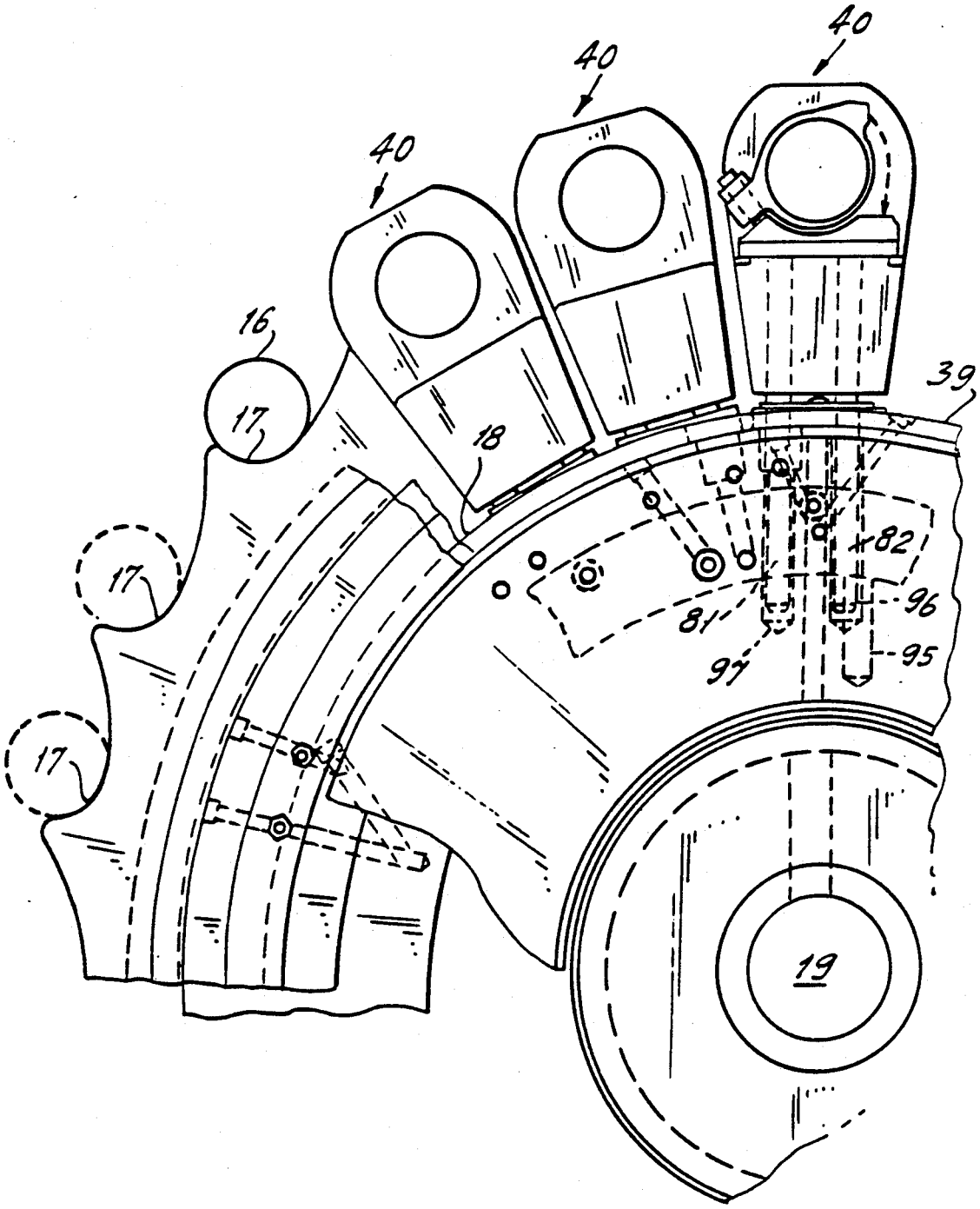
FIG. 3 is a rear elevation of the apparatus section in FIG. 2 looking in the direction of arrows 3—3 of FIG. 2.
Figure 4:
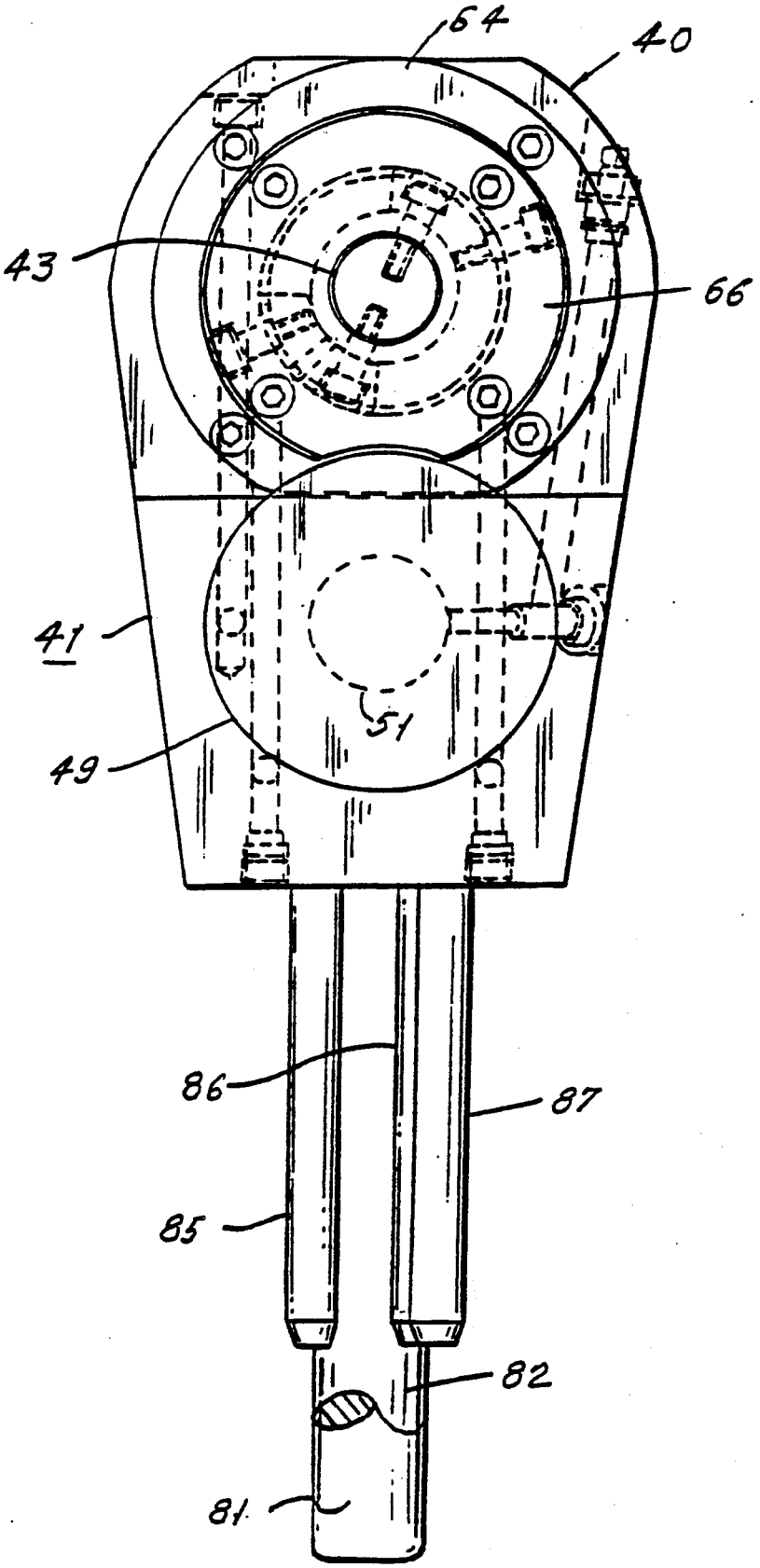
FIG. 4 is a rear elevation of one of the mandrel/actuator subassemblies.
Figure 5:
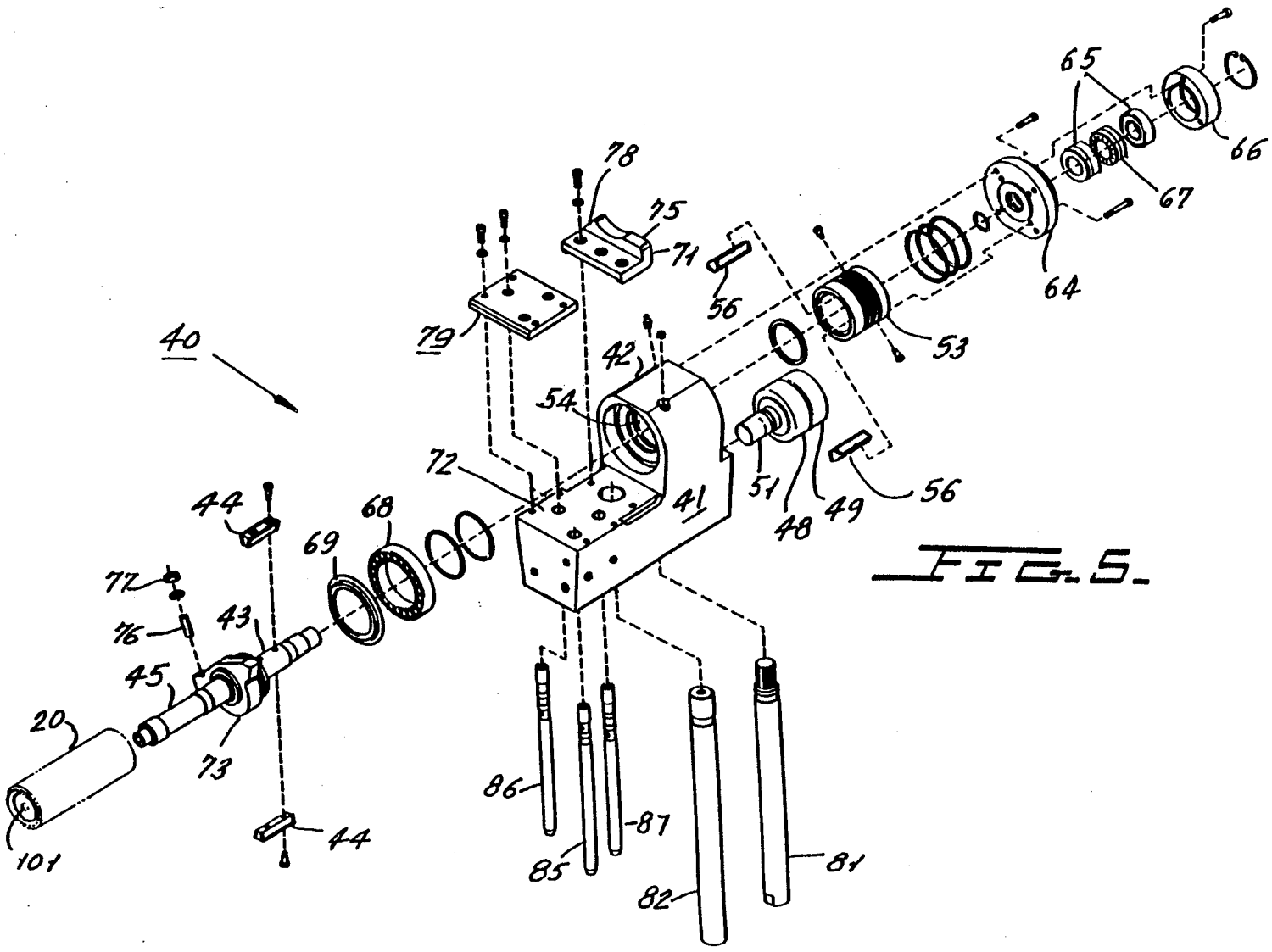
FIG. 5 is an exploded perspective of the subassembly of FIG. 4.

As may be desired to amplify the following description, disclosures of the aforesaid U.S. Pat. Nos. 3,766,851 and 4,140,053 are incorporated herein by reference. Now referring to the Figures and more particularly to FIG. 1 which illustrates continuous motion cylindrical container decorating apparatus of the general type described in the aforesaid U.S. Pat. No. 3,766,851. Briefly, the apparatus of FIG. 1 includes infeed conveyor chute 15 which receives undecorated cans 16, each open at one end thereof, from a supply (not shown) and places them in arcuate cradles or pockets 17 along the periphery of spaced rings 13, 14 (FIG. 2). The latter are fixedly secured to wheel-like carrier 18 keyed to horizontal drive shaft 19. Horizontal spindles or mandrels 20 are also mounted to wheel 18, with each mandrel 20 being in spaced horizontal alignment with an individual pocket 17 in a short region extending downstream from infeed conveyor 15. In this short region undecorated cans 16 are moved horizontally, being transferred from each cradle 17 to a mandrel 20. Suction applied through an axial passage extending to the outboard or front end of mandrel 20 draws container 16 to final seating position on mandrel 20.

While mounted on mandrels 20, cans 16 are decorated by being brought into engagement with continuously rotating image transfer mat or blanket 21 of the multicolor printing press decorating section indicated generally by reference numeral 22. Thereafter, and while still mounted to mandrels 20, each decorated can 16 is coated with a protective film of varnish applied thereto by engagement with the periphery of applicator roll 23 in the over varnish unit indicated generally by reference numeral 24. Cans 16 with decorations and protective coatings thereon are then transferred from mandrels 20 to suction cups 36 mounted near the periphery of transfer wheel 27, while the latter rotates about shaft 28 as a center. Cans 16 carried by transfer wheel 27 are deposited on generally horizontal pins 29 projecting from chain-type output conveyor 30 which carries can 16 through a curing oven (not shown).

Each mandrel 20 should be loaded properly with a can 16 by the time mandrel 20 is in the proximity of sensor 33, which detects whether each mandrel 20 contains a properly mounted can 16. As will hereinafter be explained, if sensor 33 detects that a mandrel 20 is unloaded or is not properly loaded, then as this particular mandrel 20 passes through the decorating zone, wherein printing blanket 21 normally engages can 16 on mandrel 20, this misloaded mandrel 20 is moved to a "no-print" position. In the no-print position, as this mandrel 20 moves through the decorating zone it will be spaced from the periphery of blanket 21. Each mandrel 20 is part of a mandrel/actuator subassembly 40.

There are a plurality of subassemblies 40 mounted to carrier 18 along periphery 39 thereof, there being equal angular spacing between each of the subassemblies 40 and, as will hereinafter be seen, the assemblies 40 are guided for radial movement relative to periphery 39 of carrier 18. Each assembly 40 also includes a machined base 41 having an integrally formed bulbous portion 42 that constitutes the outer housing for a pneumatically operated rotary operator or actuator which includes a rotor 43 having diametrically opposed vanes 44 secured thereto. The rotational axis for mandrel 20 is defined by integral forward longitudinal extension 45 of rotor 43. For a reason to be hereinafter seen, the rotational axis 46 for mandrel 20 and the pivot axis 47 for rotor 43 are offset slightly from one another. (Compare FIGS. 6 and 7). A pair of freely rotatable cam followers 48, 49 are mounted on cantilevered stub shaft 51 that projects from the rear of base 41. Cam follower means 48, 49 cooperate with cam track 52 to establish radial positions for base 41 relative to carrier periphery 39.

Cylindrical sleeve 53 is secured to base 41, being disposed within axial passage 54 of actuator housing 42. Stationary vanes 56, 56 are secured to insert 53, being diametrically opposed and being secured to the inner surface of insert 53. End bell 64 is secured to the rear of actuator housing 42 and, in cooperation with spacers 65, 65 and retainer 66, mounts rear bearing 67. Front bearing 68 is positioned at the front of bore 54 and is partially located by retainer 69. Rotor 43 is disposed within the chamber defined by sleeve 53 and is supported for pivotal movement by bearings 67 and 68.

Stop plate 71 is fixedly mounted to base 41 on radially outward surface 72 thereof immediately in front of actuator housing 42. Stop plate 71 cooperates with movable stop element 73 that is keyed to rotor 43 and is positioned so that surface 74 thereof engages surface 75 of stop plate 71 to establish the trip position (FIG. 6) for rotor 43. At a location remote from surface 74 element 73 mounts an adjustable stop in the form of screw 76 that engages surface 78 of stop plate 71 to establish the normal position (FIG. 7) for rotor 43. Lock nut 77 is used to retain adjusting screw 76 in adjusted position. Air passage cover plate 79 is mounted to surface 72 immediately forward of stop plate 71.

Axially spaced parallel guide rods 81, 82 extend radially inward from base 41 into guide channels 83, 84, respectively, that extend radially inward from periphery 39 of carrier 18. Guide rods 81, 82 are disposed so that the longitudinal axes thereof intersect rotational main axis 19 for carrier 18. Disposed forward of guide rods 81, 82 and projecting radially inward ward from base 41 are three hollow rods 85, 86, 87 which are entered into the respective passages 95, 96, 97 that extend radially inward from periphery 39 of carrier 18.

Each of the assemblies 40 is associated with an individual control valve 88 (FIGS. 2, 8 and 9) which is on carrier 18 and connected to hollow rods 85, 86, 87 through the respective lines 91, 92, 93, each of which consists of connected borings in carrier 18. The ends of lines 91, 92, 93 remote from control valve 88 are constituted by the respective channels 95, 96, 97. Pressurized air for operating control valve 88 is applied at opposite ends thereof through respective lines 98, 99. In particular, when pressurized air is supplied to line 98, spool 89 of valve 88 is driven to the trip position shown in FIG. 8 and when pressurized air is supplied to line 99, spool 89 is driven in the opposite direction to its reset, print, position of FIG. 9.

Line 93 is used to apply vacuum and pressure to aperture 101 at the free end of mandrel 20 through rod 87 and passage segments in base 41, as well as extension 45 that rotatably supports mandrel 20. Pressurized air for operating (pivoting) rotor 43 is provided to control valve 88 through line 102 and is exhausted from valve 88 through vents 103 and 104. In a manner known to the art, the ends of lines 98, 99 and 102 remote from control valve 88 and the end of line 93 remote from assembly 40 terminate at respective ports **98*a*, 99*a*, 102*a* and 103*a* in wear plate 199 (FIG. 2) at interface 198 between rotating carrier 18 and a relatively stationary valve plate 197**.

Figure 7:
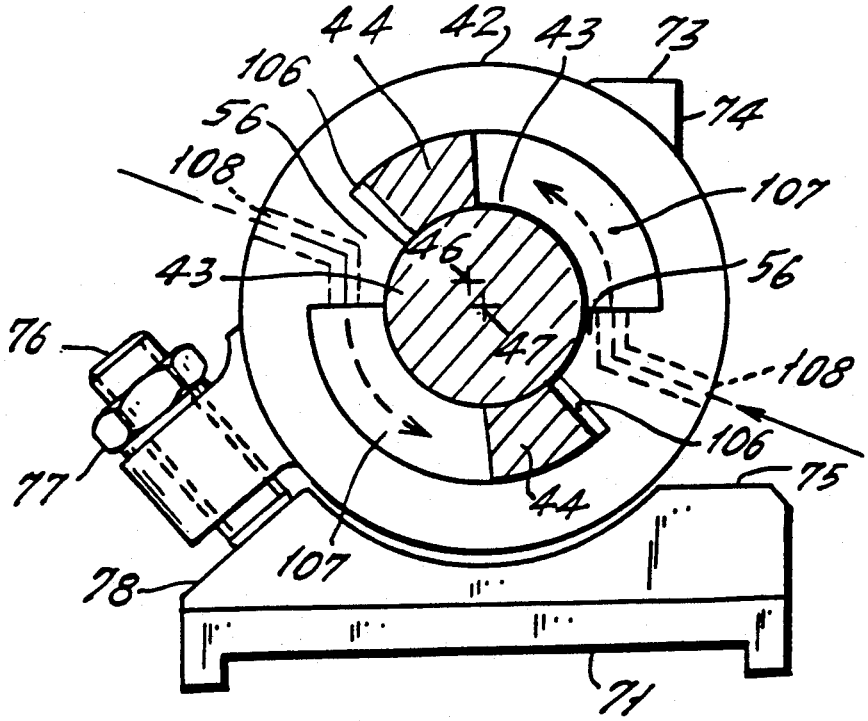
Figures 8, 9:
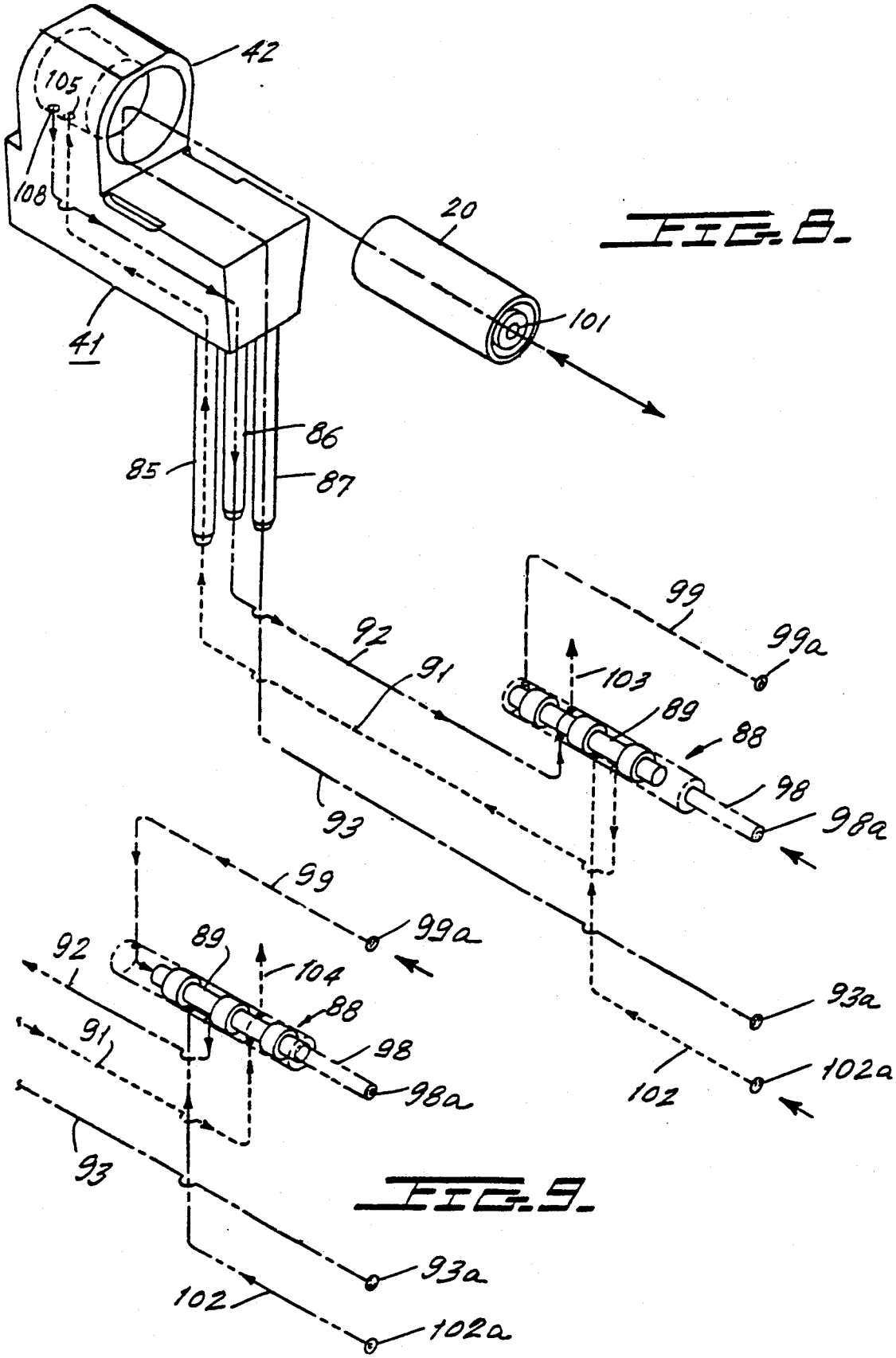
FIG. 8 is an exploded somewhat schematic perspective showing the relationship between a subassembly and its related control valve that is mounted on the carrier at a location remote from the subassembly. In this FIG. 8 the control valve is in its trip position wherein the mandrel is in a no-print position.
FIG. 9 is a schematic representation of the control valve in FIG. 8. In this FIG. 9 the control valve is in its normal position wherein the mandrel travels in its normal path for printing.

In operation, pressurized air introduced at port **98*a* drives spool 89 toward the left from its reset position of FIG. 9 to its trip position of FIG. 8. With spool 89 in its position of FIG. 8, pressurized air introduced at port 102*a* is connected through line 102, valve 88, line 91 and tube 85 to port 105 in the rotary actuator housing 42. Thus, chambers 106 between stationary vanes 56 and movable vanes 44 thereby driving rotor 43 clockwise from its print position of FIG. 7 to its trip position of FIG. 6. At this time chambers 107 between vanes 44 and vanes 56 are exhausted through port 108, line 92, valve 88 and vent 103**.

Figure 6:
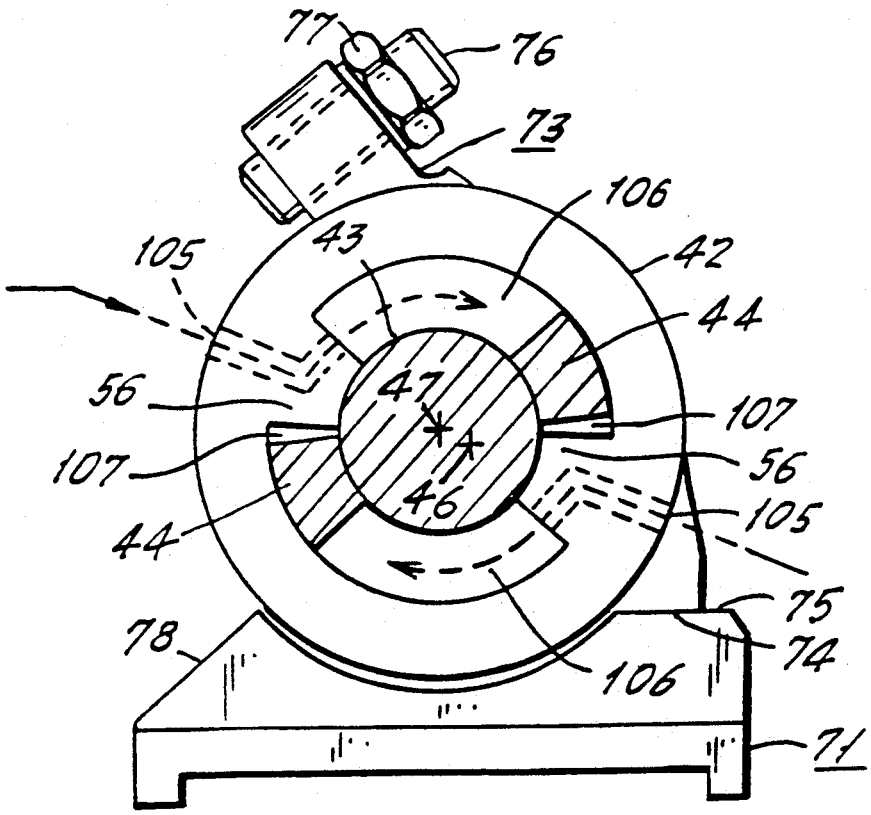
FIGS. 6 and 7 are simplified partially sectioned front end views of a rotary actuator.

Rotor 43 is pivoted counterclockwise from its trip position of FIG. 6 to its print position of FIG. 7 by introducing pressurized air at port **99*a*. This operates spool 89 to its position of FIG. 9 where control valve 88 is effective to connect pressurized port 102*a* with line 92 so that pressurized air is introduced at ports 108 and then communicated to chambers 107 between vanes 44 and 56 thereby expanding chambers 107 and driving rotor 43 counterclockwise to its print position of FIG. 7. In this position of spool 89, air is exhausted from chambers 106 through line 91 and valve 88 through vent 104**.

Radially inward movement for subassembly 40 is limited by the engagement of follower roller 48 with the radially inward surface 52*a* of closed loop cam track 52, and radially outward movement of subassembly 40 is limited by engagement of follower roller 49 with radially outward cam surface 52*b* of track 52. In order to dismount a subassembly 40 from carrier 18, the particular subassembly 40 to be removed is rotated to an approximately twelve o'clock position where follower 49 is aligned with a normally closed gap in radially outward cam surface 52*b*. This gap is normally closed by removable element 195 (FIG. 2) that defines a portion of radially outward cam surface 52*b*. With element 195 removed there is nothing blocking upward movement of cam roller 49 and the remainder of subassembly 40 so that the latter may be dismounted from carrier 18 and a replacement subassembly inserted, after which element 195 is replaced.

While subassembly 40 has been described as having rotor 43 that pivots counterclockwise, when looking at the free end of mandrel 20, to reach its normal or print position of FIG. 7, it should be obvious to one skilled in the art that subassembly 40 may be modified so that it includes a rotary actuator or operator having a rotor that pivots clockwise, when looking at the free end of the mandrel, to move the mandrel to its normal or print position.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. Apparatus for decorating cylindrical articles, said apparatus including:

a carrier mounted for continuous rotation on a main axis;

a plurality of equally angularly spaced mandrel/actuator subassemblies mounted on said carrier in an array about said main axis as a center;

decorating means past which subassemblies move as said carrier rotates;

stationary cam means disposed about said main axis;

each of said subassemblies including a cylindrical article receiving mandrel, a base, a rotary actuator on said base including a chamber and a rotor within said chamber mounted to pivot between normal and trip positions about a rotor axis which is parallel to said main axis, means extending from an end of said rotor and defining a rotational axis for said mandrel disposed laterally offset from said rotor axis, cam follower means on said base cooperating with said stationary cam means to radially position said subassembly so that an article on said mandrel will be in operative engagement with said decorating means when said rotor is in said normal position during a predetermined range of angular movement for said base about said main axis;

detecting means for determining whether an article is properly loaded on said mandrel and upon determining that said mandrel is not properly loaded, controlling operation of said actuator to pivot said rotor to said trip position wherein an article on said mandrel is disengaged from said decorating means during movement of said base through said predetermined range;

each of said rotary actuators being powered by pressurized fluid that enters said chambers.

2. Apparatus as in claim 1 for decorating cylindrical articles wherein each of said subassemblies also includes adjustable stop means to establish said normal position for said rotor.

3. Apparatus as in claim 1 for decorating cylindrical articles wherein each of said subassemblies includes guide rod means that extends into guide channel means in said carrier whereby cooperation of the cam follower means with the stationary cam means imparts linear motion to said subassemblies.

4. Apparatus as in claim 3 for decorating cylindrical articles wherein for each of the subassemblies the guide rod means extends radially inward from the base.

5. Apparatus as in claim 4 for decorating cylindrical articles wherein the carrier has a periphery from which the guide channel means extends radially inward.

6. Apparatus as in claim 5 for decorating cylindrical articles wherein said guide channel means are disposed so that their longitudinal axes intersect the main axis.

7. Apparatus as in claim 5 for decorating cylindrical articles wherein cooperation of said cam follower means and said stationary cam means retains said guide rod means against radially outward separation from said guide channel means.

8. Apparatus as in claim 7 for decorating cylindrical articles wherein said stationary cam means includes an outer guide wall having a removable section that normally closes a gap through which said cam follower means is movable to permit said subassemblies to be mounted on and dismounted from said carrier.

9. Apparatus as in claim 1 for decorating cylindrical articles also including an individual fluid operated control valve operatively connected to each of said subassemblies and through which said detecting means is effective to control said operators; said control valves being on said carrier

10. Apparatus as in claim 1 for decorating cylindrical articles wherein for each of said subassemblies the mandrel is moved radially inward as the rotor pivots from said normal position to said trip position.

11. Apparatus as in claim 1 for decorating cylindrical articles wherein cooperation of said cam follower means with said stationary cam means moves said base relative to said carrier to radially position said subassembly.

12. Apparatus as in claim 1 for decorating cylindrical articles wherein pressurized air constitutes the pressurized fluid that powers the rotary actuators.

13. Apparatus for decorating cylindrical articles, said apparatus including:

a carrier mounted for continuous rotation on a main axis;

a plurality of equally angularly spaced mandrel/actuator subassemblies mounted on said carrier in an array about said main axis as a center;

decorating means past which such subassemblies move as said carrier rotates;

stationary cam means disposed about said main axis;

each of said subassemblies including a cylindrical article receiving mandrel, a base, a rotary actuator constructed to be powered directly by a non-mechanical source of energy, said actuator being on said base and including a rotor mounted to pivot between normal and trip positions about a rotor axis which is parallel to said main axis, means extending from an end of said rotor and defining a rotational axis for said mandrel disposed laterally offset from said rotor axis, cam follower means on said base cooperating with said stationary cam means to radially position said subassembly so that an article on said mandrel will be in operative engagement with said decorating means when said rotor is in said normal position during a predetermined range of angular movement for said base about said main axis;

detecting means for determining whether an article is properly loaded on said mandrel and upon determining that said mandrel is not properly loaded, controlling operation of said actuator to pivot said rotor to said trip position wherein an article on said mandrel is disengaged from said decorating means during movement of said base through said predetermined range.

* * * * *